US006256834B1

(12) United States Patent
Meijer et al.

(10) Patent No.: US 6,256,834 B1
(45) Date of Patent: Jul. 10, 2001

(54) VACUUM CLEANER WITH DETACHABLE DUST CONTAINER

(75) Inventors: Natalie Meijer; Hans Kodden, both of Hoogeveen; Albart J. Kip, Groningen; Henk Uil, Hoogeveen; Klaas Vonk, Hoogeveen; Jan Dorgelo, Hoogeveen, all of (NL)

(73) Assignee: U.S. Philips Corporation, New York, NY (US)

( * ) Notice: Subject to any disclaimer, the term of this patent is extended or adjusted under 35 U.S.C. 154(b) by 0 days.

(21) Appl. No.: 09/464,859

(22) Filed: Dec. 16, 1999

(30) Foreign Application Priority Data

Dec. 17, 1998 (EP) ..... 98204284

(51) Int. Cl.[7] ..... A47L 9/10
(52) U.S. Cl. ..... 15/352; 15/410; 55/429
(58) Field of Search ..... 15/347, 352, 410; 55/429

(56) References Cited

U.S. PATENT DOCUMENTS

| | | | | |
|---|---|---|---|---|
| 955,886 | * | 4/1910 | Laughlin | 15/DIG. 8 |
| 3,009,188 | * | 11/1961 | Martin | 15/339 X |
| 3,177,635 | * | 4/1965 | Cawl et al. | 15/327.2 X |
| 3,524,211 | * | 8/1970 | Wolf | 15/352 X |
| 3,914,820 | * | 10/1975 | Hankel | 15/352 X |
| 3,977,037 | * | 8/1976 | Miyake et al. | 15/352 X |
| 4,426,211 | * | 1/1984 | Ataka et al. | 15/352 X |
| 5,018,240 | * | 5/1991 | Holman | 15/347 X |
| 5,664,285 | * | 9/1997 | Melito et al. | 15/347 X |
| 5,699,585 | * | 12/1997 | Tomooka et al. | 15/352 X |
| 5,935,279 | * | 8/1999 | Kilstrom | 55/429 X |
| 6,012,200 | * | 1/2000 | Murphy et al. | 15/352 X |

FOREIGN PATENT DOCUMENTS

| | | | | |
|---|---|---|---|---|
| 2226724 | | 12/1972 | (DE) . | |
| 877778 | * | 9/1961 | (GB) | 15/352 |

* cited by examiner

*Primary Examiner*—Chris K. Moore
(74) *Attorney, Agent, or Firm*—Ernestine C. Bartlett

(57) ABSTRACT

The invention relates to a vacuum cleaner comprising a housing (1) accommodating a suction unit (7). The vacuum cleaner further comprises a dust container (11) in which a dust filter (21) can be placed. The dust container is detachably coupled to the housing and comprises a handle (33) and an opening (31) via which the dust filter can be placed. According to the invention, the handle is provided on a side wall (39) of the dust container, while the opening is provided at an upper side (35) of the dust container, the upper side of the dust container being directed towards an upper side (37) of the housing in an operational position of the vacuum cleaner. In this manner, it is prevented that the dust filter can fall out of the dust container or that dust can fall out of the dust filter when the dust container is detached from the housing. In a preferred embodiment, the handle of the dust container also is a unique handle for the housing, so that the construction of the housing is simplified. In a further embodiment, the dust container is coupled to the housing by means of a first coupling device (65), which is provided near a lower side (67) of the handle, and a second coupling device (69) which is provided near an upper side (71) of the handle. In this manner, a rigid coupling of the dust container to the housing is obtained.

9 Claims, 5 Drawing Sheets

VACUUM CLEANER WITH DETACHABLE DUST CONTAINER

BACKGROUND OF THE INVENTION

The invention relates to a vacuum cleaner comprising a housing, which accommodates a suction unit, and a dust container which is detachably coupled to the housing and in which a dust filter can be placed, which dust container is provided with an opening for placing the dust filter and, on an outside with a handle.

The invention also relates to a dust container which can suitably be used in a vacuum cleaner in accordance with the invention.

A vacuum cleaner of the type mentioned in the opening paragraph is known from DE-OS-2 226 724. The known vacuum cleaner is a so-called canister-type vacuum cleaner the housing of which is provided with a number of wheels allowing the housing to be moved over a floor surface. The dust container of the known vacuum cleaner can be placed in a holder forming part of the housing. When the dust container is placed in the holder, a lower part of the dust container is recessed in the holder while an upper part of the dust container smoothly engages the housing. In this case, the handle of the dust container is situated at an upper side of the dust container while the opening of the dust container is situated in a side wall thereof facing the suction unit. The dust filter which can be placed in the dust container is a dust bag. To replace a dust bag present in the dust container, a user has to remove the dust container from the holder by means of the handle, so that the opening is exposed, the dust bag can be removed and a new dust bag can be placed in the dust container. Finally, the user has to place the dust container back in the holder. The user may, for example, carry the dust container holding the dust bag to a rubbish bin where the user can remove the dust bag from the dust container. In this manner, the dust bag is replaced in a hygienic manner.

A drawback of the known vacuum cleaner is that during removing the dust container from the holder, dust may drop from the dust bag via the opening formed in said side all of the dust container, or the dust bag may partly, or even completely, fall out of the dust container. To preclude this, during removing the dust container from the holder, the user should rotate said dust container through an angle of approximately 90° to a position where the opening faces upwards. As a result, the ease of use of the known vacuum cleaner is adversely affected.

SUMMARY OF THE INVENTION

It is an object of the invention to provide a vacuum cleaner of the type mentioned in the opening paragraph, in which the above-mentioned drawback of the known vacuum cleaner is precluded.

To achieve this, the vacuum cleaner in accordance with the invention is characterized in that the handle is provided on a side wall of the dust container, and the opening is situated at an upper side of the dust container, said upper side of the dust container facing an upper side of the housing when the vacuum cleaner is in an operating position. As a result of the fact that, in the operating position of the vacuum cleaner, the upper side of the dust container faces the upper side of the housing, the dust container already is in a position where the opening faces upwards when the vacuum cleaner is in the operating position. As a result, when the user removes the dust container from the housing, it is not necessary to rotate the dust container through a relatively large angle to preclude dust from falling out of the dust filter or the dust filter from falling out of the dust container. As a result, the ease of use of the vacuum cleaner is increased. The user may carry the dust container to a rubbish bin where the dust filter can be removed from the dust container by turning the dust container upside down. As a result of the fact that the handle is arranged on a side wall of the dust container, the ease of use of the vacuum cleaner is further increased.

It is noted that the expression "dust filter" does not only include a dust bag which can be used only once, like the dust bag used in the vacuum cleaner described in DE-OS-2 226 724, but also, for example, bag-shaped, cleanable dust filters which are made of an air-permeable material and which are intended for re-use after they have been emptied. Such a re-usable dust filter may be made of a flexible material, but also of a relatively rigid material or a rigid synthetic resin.

A particular embodiment of a vacuum cleaner in accordance with the invention is characterized in that the opening can be closed by means of a cover which is pivoted to the housing. As a result, a practical fitting of the cover is obtained, while the ease of use of the vacuum cleaner is further increased.

A further embodiment of a vacuum cleaner in accordance with the invention is characterized in that the cover is provided with a connection member to which a suction hose can be coupled, via which hose a suction accessory can be connected to the dust container and the suction unit. As a result, a practical connection of the suction hose to the dust container and the suction unit is obtained. As the cover is pivotably connected to the housing, the suction hose does not have to be uncoupled from the connection member when the dust filter is being replaced, so that the ease of use of the vacuum cleaner is further increased.

Yet another embodiment of a vacuum cleaner in accordance with the invention is characterized in that the handle is a unique handle for the housing. When the dust container is coupled to the housing, the handle of the dust container also forms a unique handle for the housing. As a result, the housing has a practical and simple construction.

A particular embodiment of a vacuum cleaner in accordance with the invention is characterized in that the dust container can be coupled to the housing by means of a first coupling member, which is provided near a lower side of the handle to co-operate with the housing, and a second coupling member which is arranged near an upper side of the handle to co-operate with the cover. Since said coupling members are provided near the handle, the dust container can be readily coupled to the housing. Such a position of the coupling members near the handle is particularly advantageous when the handle also forms a unique handle for the housing. In this case, a relatively short force-transmission path is obtained between the handle and the housing, so that the dust container is also stably coupled to the housing when the user carries the housing by means of the handle of the dust container.

A further embodiment of a vacuum cleaner in accordance with the invention is characterized in that the first coupling member has a cam for co-operating with a cam holder of the housing, which cam holder corresponds with said cam. As a result, a very rigid and stable coupling of the dust container to the housing is obtained.

Yet another embodiment of a vacuum cleaner in accordance with the invention is characterized in that the second coupling member comprises a blocking member which can be displaced by means of an operating member from a first position, wherein the blocking member blocks the cover with respect to the dust container, to a second position wherein the blocking member releases the cover. By using the blocking member and the operating member, the user can detach the dust container from the housing in a simple and practical manner by moving the blocking member from its first position to its second position by means of the operating member.

A particular embodiment of a vacuum cleaner in accordance with the invention is characterized in that the operating member is arranged in an upper side of the handle. As a result, the operating member is in a practical position enabling the user to grip the handle and operate the operating member with one hand. By virtue thereof, the ease of use of the vacuum cleaner is further increased.

A further embodiment of a vacuum cleaner in accordance with the invention is characterized in that the second coupling member includes a safety member which locks the blocking member in its first position if the housing is not in the operating position. By using said safety member, the blocking member of the second coupling, member can only release the cover if the housing of the vacuum cleaner is in the operating position. By virtue thereof, it is precluded that the dust container can be uncoupled from the housing if the housing is carried by the user by means of the handle of the dust container.

BRIEF DESCRIPTION OF THE DRAWINGS

These and other aspects of the invention will be apparent from and elucidated with reference to the embodiments described hereinafter.

In the drawings.

A DESCRIPTION OF THE PREFERRED EMBODIMENTS

Figure 1A:
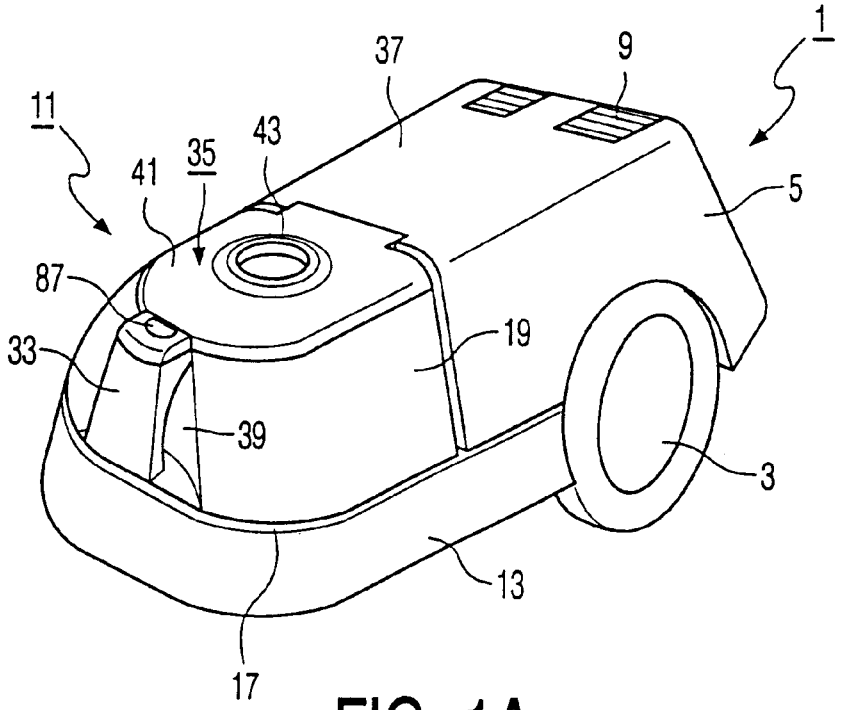
FIG. 1*a* diagrammatically shows a vacuum cleaner in accordance with the invention, wherein a dust container of the vacuum cleaner is coupled to a housing of the vacuum cleaner, FIG. 1*b* diagrammatically shows the vacuum cleaner in accordance with FIG. 1*a*, wherein the dust container is uncoupled from the housing.
Figure 1B:
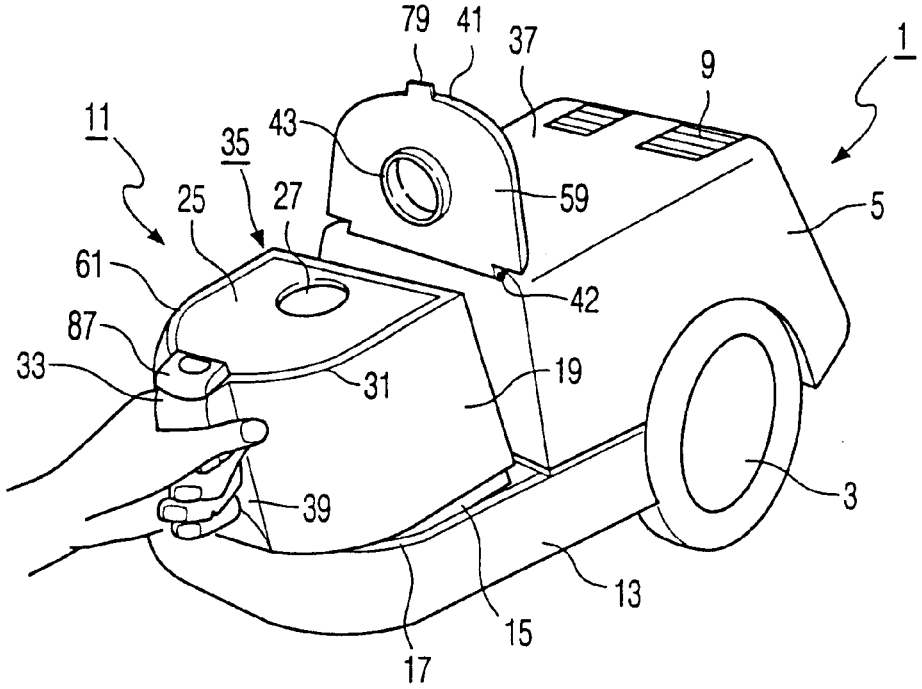
Figure 2A:
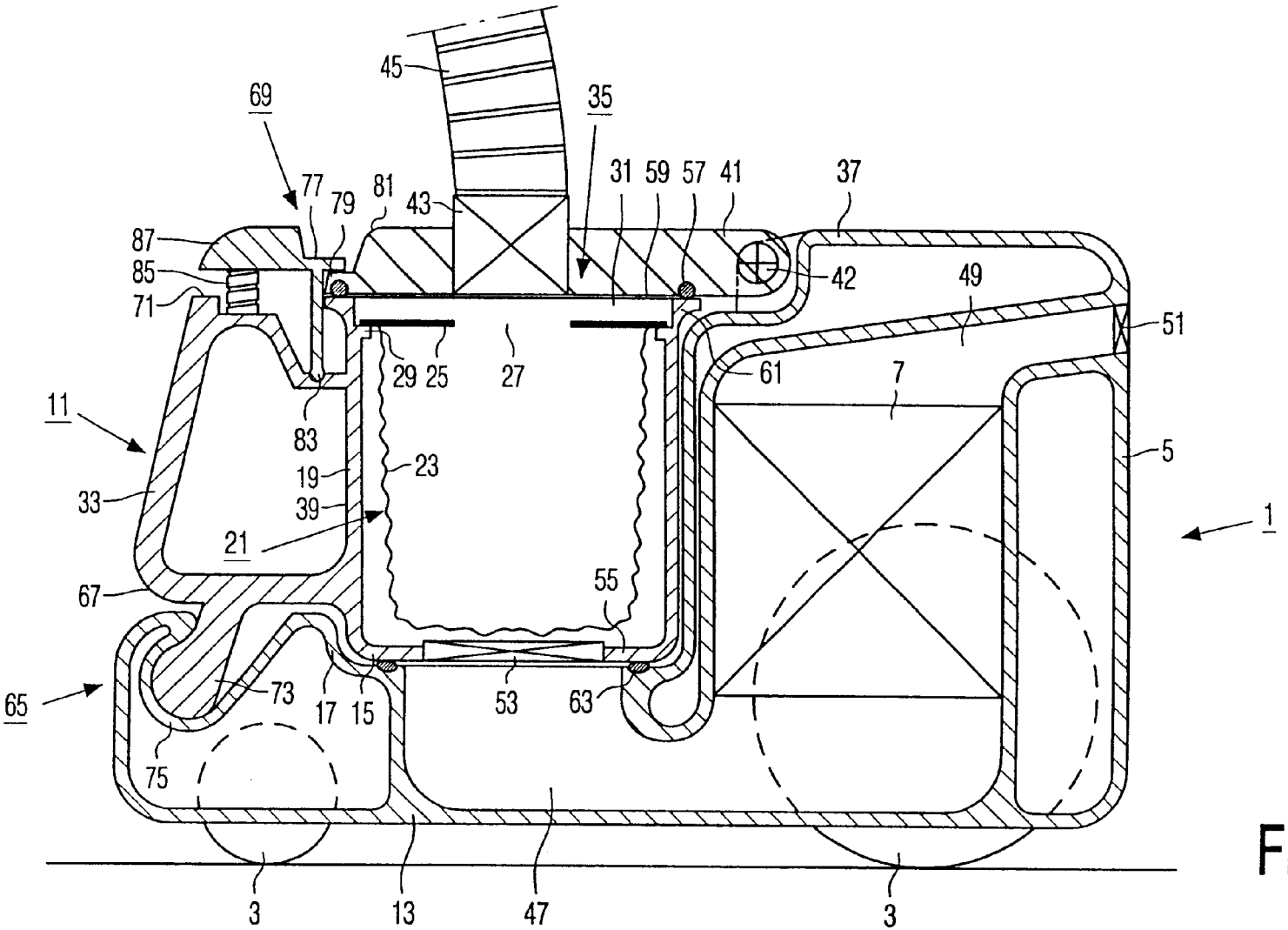
FIG. 2*a* is a diagrammatic, sectional view of the vacuum cleaner in accordance with FIG. 1*a*, wherein the dust container is coupled to the housing.

The vacuum cleaner in accordance with the invention, as shown in the Figures, is a so-called canister-type vacuum cleaner, which comprises a synthetic resin housing 1 which can be moved, by means of a number of wheels 3, over a floor surface. As shown in the FIGS. 2*a*, 2*b* and 2*c*, an electrical suction unit 7 is arranged in a rear part 5 of the housing 1, which suction unit can be switched on and off by means of a switch 9 arranged on the housing 1. The vacuum cleaner further comprises a cup-shaped dust container 11 which is detachably coupled to the housing 1 and which, in the example shown, is made of the same synthetic resin material as the housing 1. In FIGS. 1*a* and 2*a*, the dust container 11 is shown in a position in which it is coupled to a front part 13 of the housing 1, while the dust container 11 shown in FIGS. 1*b* and 2C is in a position wherein it is uncoupled from the housing 1. In the coupled position, a lower part 15 of the dust container 11 is recessed in a holder 17 which is provided in the front part 13 of the housing 1. An upper part 19 of the dust container 11 has contours which, in the coupled position of the dust container 11, substantially blend with the contours of the housing 1. In this manner, the dust container 11 in the coupled position is perceived as forming one whole with the housing 1, so that the vacuum cleaner has a smooth appearance.

Figure 2B:
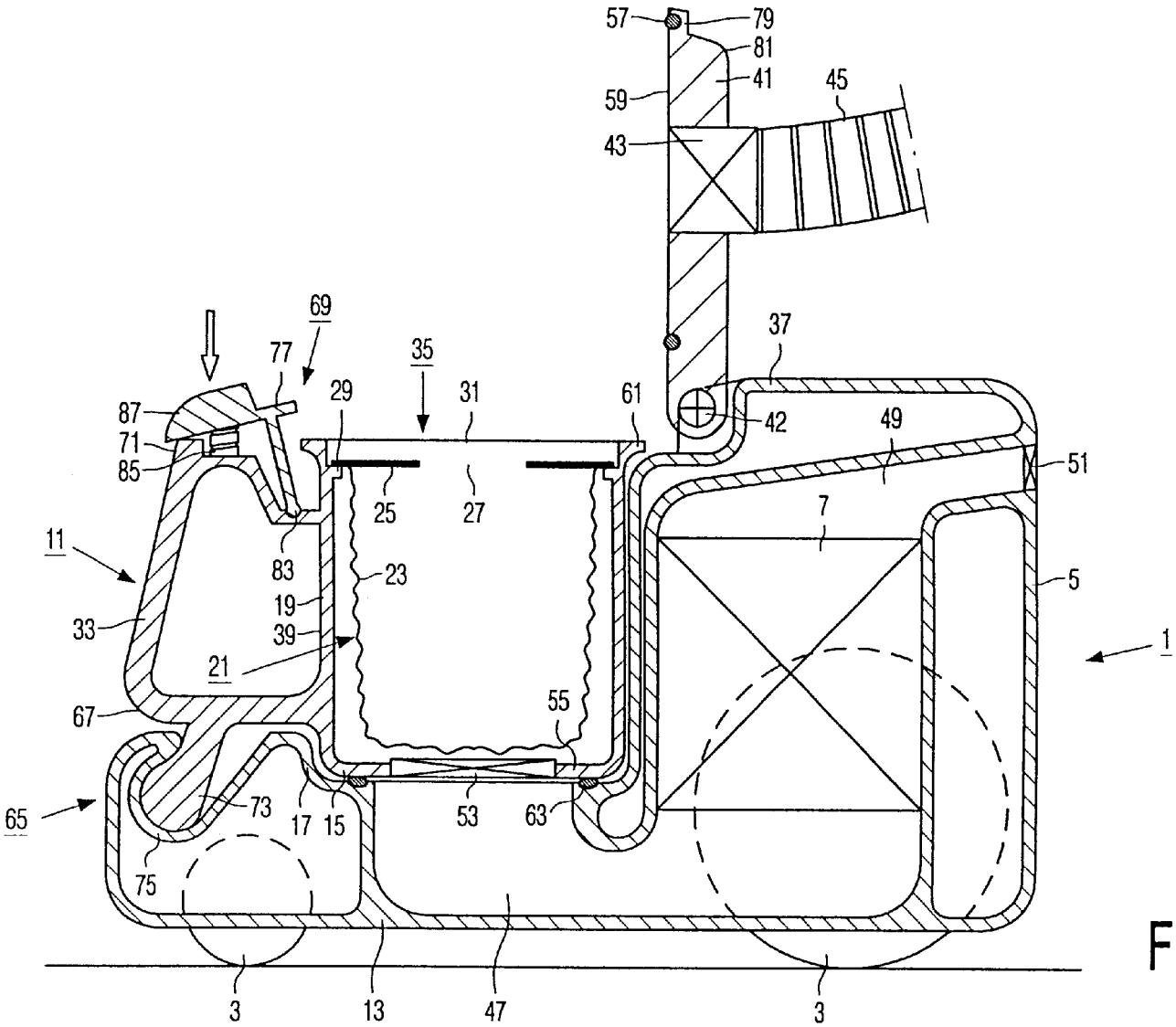
FIG. 2*b* is a sectional view in accordance with FIG. 2*a*, wherein a cover of the dust container is open.
Figure 2C:
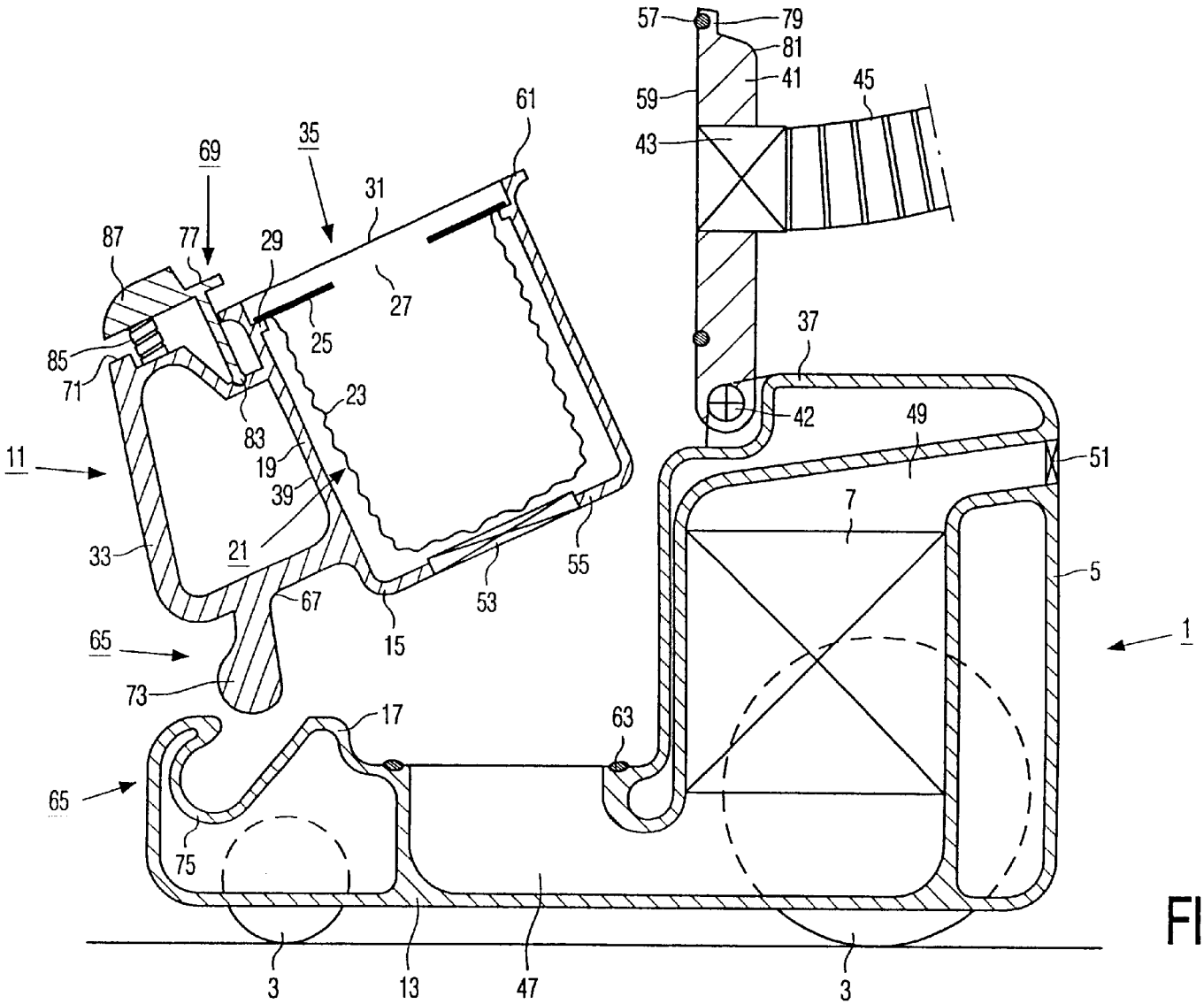
FIG. 2*c* is a sectional view in accordance with the FIG. 2*a*, wherein the dust container is uncoupled from the housing.

As shown in FIGS. 2*a*, 2*b* and 2*c*, a dust filter can be introduced into the dust container 11. In the example shown, the dust filter is a dust bag 21 of a customary type for one-time use, which is known per se. The dust bag 21 is provided with a paper filter bag 23 which is attached to a relatively rigid plate 25 of, for example, cardboard having a central opening 27. The plate 25 of the dust bag 21 can be placed in a holder 29 which is provided in the dust container 11 near an opening 31 of the dust container 11. Via the opening 31, the dust bag 21 can be placed in the dust container 11, or replaced, by a user of the vacuum cleaner. As noted hereinabove, the invention also includes embodiments wherein another type of dust filter, such as a re-usable dust filter, is used in the dust container 11 instead of the dust bag 21. In addition, the dust container 11 is provided on an outside with a handle 33 by means of which the user can remove the dust container 11 from the holder 17 and place it back in the holder 17. The handle 33 is situated on the upper part 19 of the dust container 11 and, hence, is clearly visible and readily accessible to the user in the coupled position of the dust container 11.

The Figures show the housing 1 of the vacuum cleaner in an operating position wherein the housing 1 is placed in a horizontal position on a floor surface with the wheels 3. In accordance with the invention, the opening 31 of the dust container 11 is situated at an upper side 35 of the dust container 11, the upper side 35 of the dust container 11, in the operating position of the vacuum cleaner shown, facing an upper side 37 of the housing 1. In addition, in accordance with the invention, the handle 33 of the dust container 11 is provided on a side wall 39 of the dust container 11.

If the dust container 11 is placed in the holder 17, the opening 31 of the dust container 11 can be closed by means of a cover 41, which is shown in the Figures and which is pivotably connected to the housing 1 near the upper side 37 of the housing 1 by means of a hinge 42. The cover 41 is provided with a connection member 43, which is only diagrammatically shown in the Figures, to which a suction hose 45 of the vacuum cleaner can be coupled. It is noted that the suction hose 45 is shown only in FIGS. 2*a*, 2*b* and 2*c*. Via the suction hose 45, a suction accessory of the vacuum cleaner, which for the sake of simplicity is not shown in the Figures, can be connected to the connection member 43, which suction accessory is provided, for example, with a suction mouth and a hollow tube. In the shown example of the vacuum cleaner in accordance with the invention, the connection member 43, the suction hose 45 and the suction accessory, which is not shown, are of a known, customarily used type. In the coupled position of the dust container 11, shown in FIG. 2*a*, said suction accessory, the suction hose 45, the connection member 43, the dust container 11 and the suction unit 7 form an air-flow duct of the vacuum cleaner, which air-flow duct is further provided with a connection duct 47, which is provided in the housing 1 and connects the dust container 11 to the suction unit 7, and with an outflow duct 49, which is also arranged in the housing 1 and connects the suction unit 7 to an air outlet 51. Said air-flow duct further comprises a permanent end filter 53, which is customary per se, and which is detachably provided in a lower side 55 of the dust container 11. Since the end filter 53 is provided in the lower side 55 of the dust container 11, said end filter 53 can be readily replaced after the dust container 11 has been removed from the holder 17. It is noted that, in comparison with the dust bag 21, the end filter 53 has to be replaced only a limited number of times. Said air-flow duct is sealed near the upper side 35 of the dust container 11 by means of a first rubber sealing ring 57, which is provided in a lower side 59 of the cover 41 to co-operate with a flange 61 of the dust container 11, and said air-flow duct is sealed near the lower side 55 of the dust container 11 by means of a second rubber sealing ring 63, which is provided in the holder 17 of the housing 1 so as to co-operate with the lower side 55 of the dust container 11.

As shown in FIGS. 1*a* and 2*a*, the handle 33 of the dust container 11 is situated, in the coupled position of the dust container 11, near a front side of the housing 1, said handle 33 also forming a unique handle for the housing 1 which enables the user to bodily carry or move the housing 1. As a result, the housing 1 does not have to be provided with a further handle, so that the construction of the housing 1 is both practical and simple.

In the coupled position shown in FIGS. 1*a* and 2*a*, the dust container 11 is coupled to the housing 1 by means of a first coupling member 65 which is provided near a lower side 67 of the handle 33 so as to co-operate with the housing 1, and a second coupling member 69 which is provided near an upper side 71 of the handle 33 so as to co-operate with the cover 41. As shown in FIG. 2*a*, the first coupling member 65 has a cam 73 which is provided at the lower side 67 of the handle 33 so as to co-operate with a cam holder 75 corresponding with the cam 73, which cam holder is arranged in the front part 13 of the housing 1. The second coupling member 69 has a blocking member 77 for co-operating with a flange 79 of the cover 41, which flange is situated on a side 81 of the cover 41 opposite the hinge 42. The blocking member 77 is pivotably journalled in the upper side 71 of the handle 33 by means of a bearing 83. The second coupling member 69 further comprises a pre-tensioned mechanical spring 85 which holds the blocking member 77 in a first position shown in FIG. 2*a*, in which position the blocking member 77 locks the cover 41 in a closed position with respect to the dust container 11 by co-operation with the flange 79. The second coupling member 69 further comprises an operating member 87 which is integrated with the blocking member 77. By means of the operating member 87, the blocking member 77 can be pivoted by the user, against the pre-tension of the mechanical spring 85, from the first position shown in FIG. 2*a* to a second position shown in FIG. 2*b*, wherein the blocking member 77 releases the cover 41 so that the cover 41 can be opened by the user. As shown in the Figures, the operating member 87 is situated in the upper side 71 of the handle 33. As a result, with one hand, the user can both grip the handle 33 and operate the operating member 87, for example using the thumb. With the other hand, the user can simultaneously open the cover 41. The hinge 42 may however alternatively be provided with means, such as a torsion spring, for automatically opening the cover 41 after this has been released by the blocking member 77. In combination with, or instead of, said torsion spring, also a mechanical spring or another type of elastic element may be used, which is secured to the lower side 59 of the cover 41 and, in a closed position of the cover 41, rests against the plate 25 of the dust bag 21. Such a spring keeps the dust bag 21 in position in the dust container 11 when the cover 41 is opened.

Relatively short force-transmission paths between the handle 33 and the housing 1 are obtained in that the first coupling member 65 and the second coupling member 69, as described hereinabove, are provided near the handle 33. As a result, the dust container 11 is coupled in a rigid and stable manner to the housing 1 when the user carries the housing 1 by means of the handle 33 of the dust container 11. Said rigid and stable coupling between the dust container 11 and the housing 1 is obtained, in particular, by using the cam 73 and the cam holder 75 just below the handle 33. When carrying the housing 1 by means of the handle 33, the relatively short force-transmission path between the handle 33 and the cam 73 causes a mechanical moment exerted on the cover 41 by the dust container 11 to be limited as possible, so that the mechanical load on the second coupling member 69 is limited as much as possible. This results in a reliable operation of the second coupling member 69 and the blocking member 77. The rigid and stable coupling between the dust container 11 and the housing 1 additionally results in stable contact pressures between the first sealing ring 57 and the flange 61 of the dust container 11, and between the second sealing ring 63 and the lower side 55 of the dust container 11, so that reliable seals are obtained by means of the sealing rings 57 and 63.

If the user wishes to replace the dust bag 21 present in the dust container 11, then the user must uncouple the dust container 11 from the housing 1. As described hereinabove, this is achieved by a displacement of the operating member 87 in a direction indicated by means of an arrow in FIG. 2*b*, whereafter the cover 41 can be opened. Since the connection member 43 for the suction hose 45 and the above-mentioned suction accessory is situated on the cover 41, the suction hose 45 does not have to be uncoupled from the housing 1 to replace the dust bag 21, as is shown in FIGS. 2*b* and 2*c*. As a result, the connection of the suction hose 45 to the housing 1 is both practical and user-friendly. Subsequently, the user has to remove the dust container 11 from the holder 17. For this purpose, the user should pivot the dust container 11 through a relatively small angle, as shown in FIG. 2*c*, so that the cam 73 is released from the cam holder 75. To simplify the removal of the dust container 11, the vacuum cleaner may be provided, in an alternative embodiment, with, for example, a mechanical spring or another type of elastic element which is accommodated in the holder 17 and engages, under pre-tension, the lower side 55 of the dust container 11, preferably in a position opposite the cam 73. By virtue of the facts that the opening 31 of the dust container 11 is situated at the upper side 35 of the dust container 11, the upper side 35 of the dust container 11 faces the upper side 37 of the housing 1, in the operating position of the vacuum cleaner, and, upon removing the dust container 11 from the holder 17, the dust container 11 only has to be pivoted through a relatively small angle, it is precluded that, upon removing the dust container 11 from the holder 17, the dust bag 21 can fall either entirely or partly out of the dust container 11, or that dust present in the dust bag 21 can fall out of the dust bag 21. The dust container 11 with the dust bag 21 contained therein can be carried by the user to a rubbish bin, where the dust bag 21 can be removed from the dust container 11 by turning the dust container 11 upside-down above the rubbish bin. After providing a new dust bag, the dust container 11 can be placed back in the holder 17. Since the first coupling member 65 is provided near the handle 33, the first coupling member 65 is situated near the hand of the user during placing the dust container 11 in the holder 17, so that the action of making the cam 73 engage with the cam holder 75 is simplified. The process of uncoupling, removing and emptying the dust container 11 can be carried out by the user with one hand, as can the subsequent replacement of the dust container 11 in the holder 17 after the dust container 11 has been provided with a new dust bag.

Figure 3:
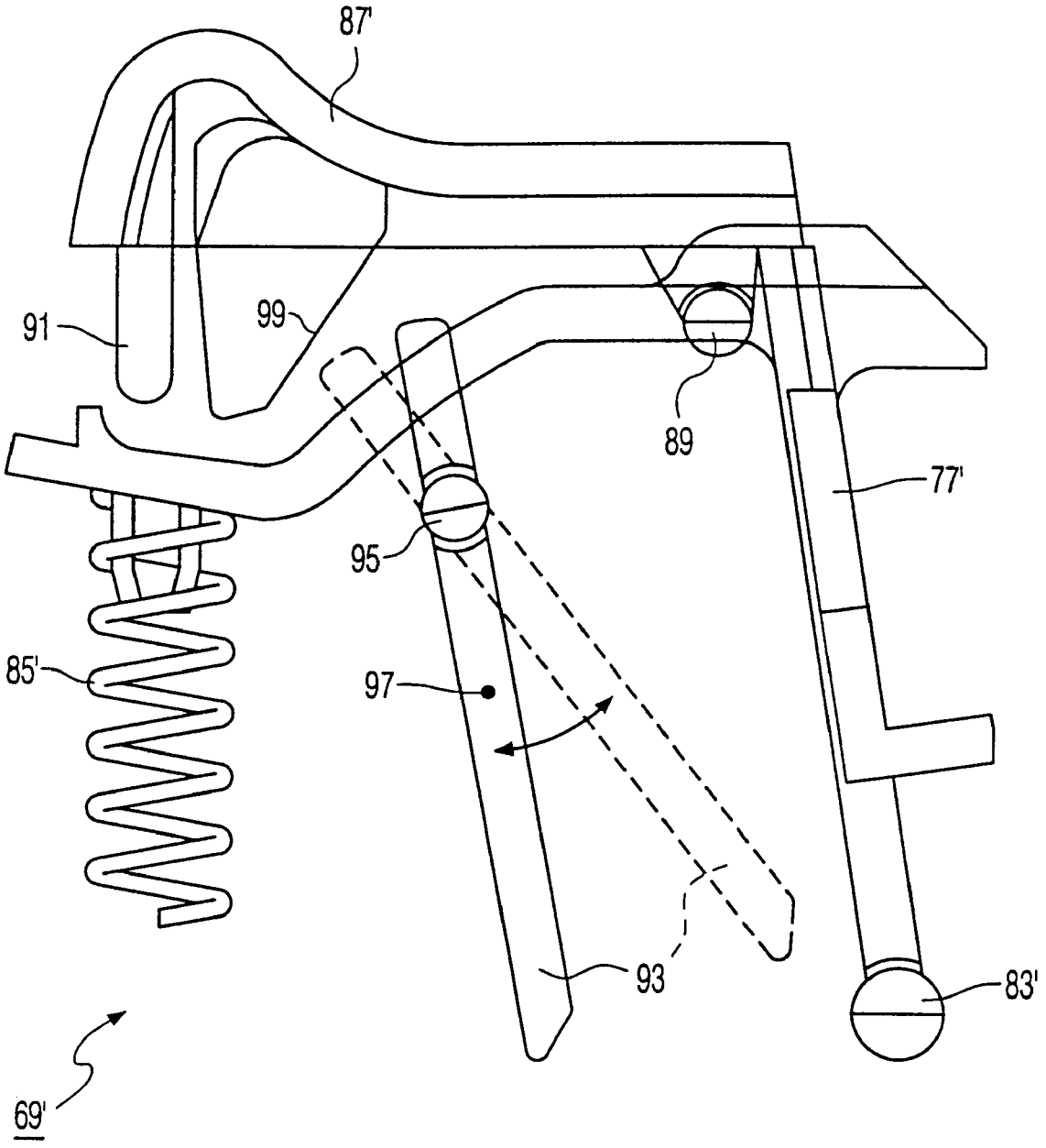
FIG. 3 is an alternative embodiment of a coupling member of the dust contained of the vacuum cleaner in accordance with FIG. 1*a*.

FIG. 3 shows an alternative embodiment of the second coupling member 69', which can be used instead of the above-described second coupling member 69. Said second coupling member 69' comprises a blocking member 77' for co-operation with the flange 79 of the cover 41. By means of a bearing 83', the blocking member 77' is pivotably journalled in the upper side 71 of the handle 33. The second coupling member 69' further comprises a pretensioned mechanical spring 85' which keeps the blocking member 77' in a first position, as shown in FIG. 3, wherein the blocking member 77' locks the cover 41 in a closed position with respect to the dust container 11 by co-operation with the flange 79. The second coupling member 69' further comprises an operating member 87' which is also pivotably journalled in the upper side 71 of the handle 33 by means of a bearing 89 and is provided with a stop 91 for co-operation with the blocking member 77'. By means of the operating member 87', the blocking member 77' can be pivoted by the user against the pre-tension of the mechanical spring 85' from a first position shown in FIG. 3 to a second position wherein the blocking member 77' releases the cover 41. The second coupling member 69' also comprises a safety member 93 which is also pivotably journalled in the upper side 71 of the handle 33 by means of a bearing 95. As shown in FIG. 3, a center of gravity 97 of the safety member 93 is situated below the bearing 95, so that in the operating position of the housing 1 of the vacuum cleaner, the safety member 93 is in a position shown in FIG. 3 under the influence of the force of gravity, in which position the safety member 93 releases the operating member 87' and the blocking member 77'. If the housing 1 of the vacuum cleaner is carried by the user by means of the handle 33 of the dust container 11, then, under the influence of the force of gravity, the safety member 93 is in a position shown by means of dashed lines in FIG. 3. In this position, the safety member 93 locks the operating member 87' and hence the blocking member 77' in its first position by co-operation with a stop 99 provided on the operating member 87', so that the dust container 11 cannot be uncoupled from the housing 1. By using the safety member 93, it is thus prevented that the user can unintentionally uncouple the dust container 11 from the housing 1, if the user carries the housing 1 by means of the handle 33 of the dust container 11.

The vacuum cleaner in accordance with the invention, as described hereinabove, is a so-called canister-type vacuum cleaner. It is noted that the invention also includes other types of vacuum cleaners, such as upright vacuum cleaners. Such an upright vacuum cleaner comprises a housing which, in an operating position of the upright vacuum cleaner, is in a substantially vertical position. In such an upright vacuum cleaner in accordance with the invention, the housing comprises a dust container having an opening which, in said operating position of the upright vacuum cleaner, faces an upper side of the housing, and a handle which is provided on a side wall of the dust container.

In the vacuum cleaner in accordance with the invention, as described hereinabove, the upper side 35 of the dust container 11 is situated near the upper side 37 of the housing 1 in the coupled position of the dust container 11. When the dust container 11 is removed from the housing 1, said dust container 11 should be removed from the holder 17 in a substantially vertical direction. In accordance with the invention, the dust container in the coupled position may alternatively be situated elsewhere in the housing, for example in a position where the upper side and the lower side of the dust container are at some distance from, respectively, the upper side and the lower side of the housing. In such an alternative embodiment of a vacuum cleaner in accordance with the invention, which is readily conceivable in the case of, for example, upright vacuum cleaners, the dust container should be removed from the housing in a substantially horizontal direction. The expression "wherein the upper side of the dust container faces an upper side of the housing in an operating position of the vacuum cleaner", used in the claims, consequently indicates a direction in which the dust container is arranged with respect to the housing, and is not limited to an embodiment wherein the upper side of the dust container is situated near the upper side of the housing.

Finally, it is noted that the invention also includes embodiments of the vacuum cleaner wherein the cover forms part of the dust container, and, for example, is pivotably connected to the dust container, or embodiments wherein the housing comprises an additional handle so that the housing can also be carried without the dust container, and/or embodiments wherein the dust container can be coupled to the housing by means of a different number and/or different type of coupling member.

What is claimed is:

1. A vacuum cleaner comprising a housing, which accommodates a suction unit, a cover pivotable to said housing and a dust container which is detachably coupled to said housing and in which dust container a dust filter is provided, said dust container provided with an opening for introducing the dust filter into said dust container and, on an outside, with a handle, characterized in that the handle is provided on a side wall of said dust container, and the opening is situated at an upper side of said dust container, the upper side of said dust container facing the cover when the vacuum cleaner is in an operating position.

2. A vacuum cleaner as claimed in claim 1, characterized in that the handle also forms a handle for the housing.

3. A vacuum cleaner as claimed in claim 1 wherein the opening is closable by the cover.

4. A vacuum cleaner as claimed in claim 3, characterized in that the dust container is coupled to the housing by means of a first coupling member, which is provided near a lower side of the handle to co-operate with the housing, and a second coupling member which is arranged near an upper side of the handle to co-operate with the cover.

5. A vacuum cleaner as claimed in claim 4, characterized in that the first coupling member has a cam for co-operating with a cam holder of the housing, which cam holder conforms to with said cam.

6. A vacuum cleaner as claimed in claim 4 wherein the second coupling member comprises a blocking member which can be displaced by means of an operating member from a first position, wherein the blocking member locks the cover in a closed position with respect to said dust container, to a second position wherein the blocking member releases the cover.

7. A vacuum cleaner as claimed in claim 6, characterized in that the operating member is arranged in an upper side of the handle.

8. A vacuum cleaner as claimed in claim 6, characterized in that the second coupling member includes a safety member which locks the blocking member in its first position if the housing is not in the operating position.

9. A vacuum cleaner as claimed in claim 3 wherein the cover is provided with a connection member suitable for coupling to a suction hose, said suction hose being adapted to connect a suction accessory to said dust container and the suction unit.

* * * * *